US005417779A

United States Patent [19]

Griebel, III et al.

[11] Patent Number: 5,417,779

[45] Date of Patent: May 23, 1995

[54] HIGH DUCTILITY PROCESSING FOR ALPHA-TWO TITANIUM MATERIALS

[75] Inventors: Arthur H. Griebel, III, Troy, Mich.; Carl E. Kelly, Jr., Southington, Conn.

[73] Assignee: United Technologies Corporation, Hartford, Conn.

[21] Appl. No.: 239,484

[22] Filed: Sep. 1, 1988

[51] Int. Cl.[6] ..... C22C 14/00

[52] U.S. Cl. ..... 148/421; 148/670

[58] Field of Search ..... 420/420; 148/421, 670

[56] References Cited

U.S. PATENT DOCUMENTS 4,292,077 9/1981 Blackburn et al. ..... 75/175.5

4,294,615 10/1981 Blackburn et al. ..... 148/11.5 F 4,716,020 12/1982 Blackburn et al. ..... 75/175.5

*Primary Examiner*—Ngoclan T. Mai

*Attorney, Agent, or Firm*—Charles E. Sohl

[57] ABSTRACT

A thermal mechanical processing sequence for application to alpha-two type titanium is discussed. A typical alloy composition is 14% aluminum, 23% niobium, 2% vanadium, and balance titanium. Tensile ductilities in excess of 10% and up to about 40% are provided in this material by a processing sequence which includes multiple working steps below the beta transus with intervening thermal anneals also at temperatures below the beta transus. Typical rolling start temperatures would be on the order 954° C. (1750° F.). Typical annealing temperatures range from 732° C. (1350° F.) to 954° C. (1750° F.).

7 Claims, 1 Drawing Sheet

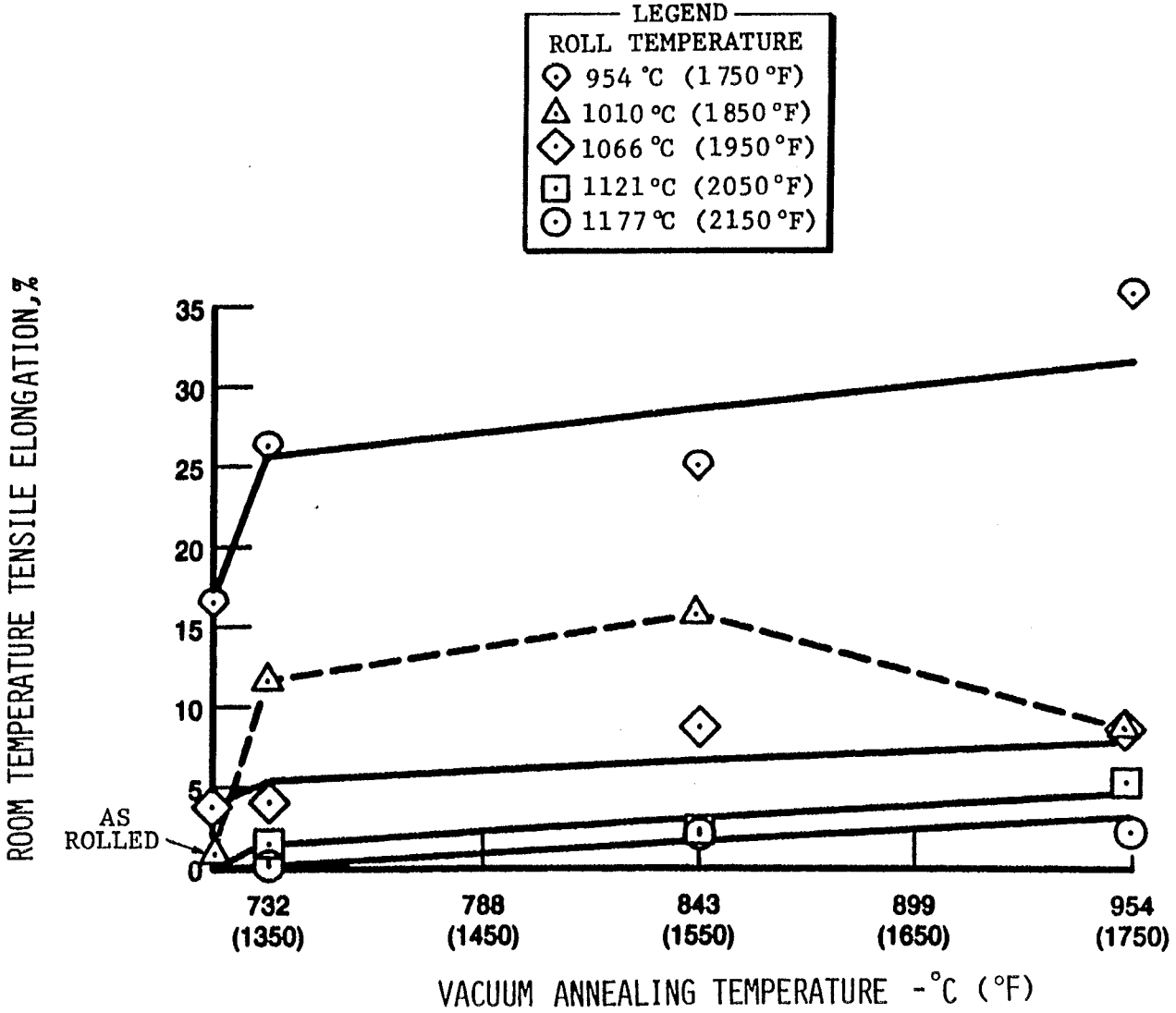
LEGEND
ROLL TEMPERATURE
954 °C (1750 °F)
1010 °C (1850 °F)
1066 °C (1950 °F)
1121 °C (2050 °F)
1177 °C (2150 °F)
35
30
25
20
15
10
5
0
AS ROLLED
732 (1350)
788 (1450)
843 (1550)
899 (1650)
954 (1750)
VACUUM ANNEALING TEMPERATURE - °C (°F)
ROOM TEMPERATURE TENSILE ELONGATION,%

HIGH DUCTILITY PROCESSING FOR ALPHA-TWO TITANIUM MATERIALS

The Government has rights in this invention pursuant to a contract awarded by the Department of the Air Force.

TECHNICAL FIELD

This invention relates to the processing of titanium base alloys of the $Ti_3Al$ (alpha-two) type to produce substantial low temperature ductility.

BACKGROUND ART

Titanium alloys based on the intermetallic compound Ti3Al (and also known as alpha-two materials) have been the subject of interest and investigation for a number of years. These materials offer the promise of good high temperature properties in combination with low density and useful oxidation resistance.

Heretofore however, these alloys have not found application because of limited low temperature ductility. While certain of these alloys can be hot worked at temperatures near and above their beta transus temperatures (typically 1950°–2150° F.), the room temperature ductility of these materials has been on the order of 3–7% maximum tensile elongation with 1–3% being typical. Materials with such low ductilities are not desirable engineering materials because it is difficult to fabricate them into useful shapes except at high temperatures and their utilization at low temperatures can be a problem because of the potential for handling damage. Cracks formed by mishandling during production and assembly could propagate during service leading to failure.

A complete understanding of the invention requires knowledge of the phase relationships in these alloys. Two phases can occur, the alpha-two phase has an ordered hexagonal close packed crystal structure while the beta phase has body centered cubic structure. All materials which are useful in conjunction with the invention are 100% beta above a certain temperature known as the beta transus. When cooled below this temperature they transform wholly or partially to alpha-two. Some amount of residual beta is desired since it appears to enhance ductility, however the invention is applicable to material which is entirely alpha-two at room temperature.

U.S. Pat. Nos. 4,292,077 and 4,716,020 which share some common inventors with the present invention and which are assigned to the same assignee describe two of the most successful alpha-two type alloys. These alloys have the best combination of properties heretofore obtained in this alloy field. These properties are obtained by careful compositional control. U.S. Pat. No. 4,292,077 discloses vanadium additions to titanium-aluminum-niobium alpha-two type alloys for increased ductility where vanadium generally substitutes for titanium. Tables 2 and 4 in this patent show room temperature ductility values for the invention alloys with a maximum ductility of 4% being shown in Table 2 and a maximum of 1.3% being shown in Table 4. U.S. Pat. No. 4,716,020 adds molybdenum to the alloys of 4,292,077, the maximum low temperature elongation disclosed in this patent appears to be 2.2% as shown in Table 1, although a number 2.5% is mentioned in column 3 at line 38.

These two patents suggest similar processing techniques, specifically "solutionizing or forging should be conducted above the beta transus followed by aging between 700°–900° C. for 2–24 hours (U.S. Pat. No. 4,716,020 column 5, lines 20–25).

As used herein, tensile elongation is determined using a 0.75 inch gauge length specimen. All compositions are listed as weight percents unless otherwise noted.

DISCLOSURE OF INVENTION

An object of the present invention is to provide a processing sequence for $Ti_3Al$ type alpha-two alloy materials which provides a room temperature tensile ductility of at least 10% and preferably at least 20%.

The alloys to which the present invention process can be applied are based on the $Ti_3Al$ or alpha-two phase. The broadest description of the present invention is that it can be applied to composition which comprise the alpha-two and beta phases at room temperature. Preferably the beta phase is present as a discontinuous phase in amounts of from 5 to 80 vol. %. While the composition listed herein are in weight percent, it is also useful to consider the compositions on an atomic basis as this gives some insight into the structure of the materials and the roles played by various added elements.

In terms of composition, Table I presents broad and preferred ranges for the invention composition on a weight percent basis. It is preferred that the invention composition on an atomic basis comprise from 24–27 atom percent aluminum, 11–16 atom percent [niobium+molybdenum+vanadium+tantalum+chromium+tungsten] balance titanium. As shown in Table I certain other elements may be present in small amounts and/or as impurities. Silicon is known to be a useful addition for titanium alloys to improve creep strength. Iron, carbon, oxygen and hydrogen do not serve any apparent useful function in this alloy system and are therefore treated as impurities.

The major preferred alloying ingredients based on our current state of knowledge are aluminum, niobium, molybdenum, and,vanadium. The inclusion of chromium, tungsten and silicon in the invention in the amounts shown is based on prior work in this alloy system and other related alloy systems. The most preferred composition in the present invention involves only aluminum, niobium, molybdenum, vanadium and titanium.

The refractory metal additions (niobium, molybdenum, vanadium, tantalum, chromium, and tungsten) serve to strengthen the alloy at some cost in ductility. Molybdenum has the most potent effect in increasing strength and decreasing ductility and consequently is limited to the ranges shown in Table I. We have had difficulty in processing alloys containing much more than about 6% molybdenum because of their lack of ductility. Based on other work we believe that tungsten will have a similarly strong effect and therefore limit tungsten to the same range. Additionally tungsten is not desirable for material destined for aerospace applications since it increases the density of the material significantly. We believe that chromium will also have a strong effect on the strength of ductility and therefore it is limited likewise. We believe that tantalum is more analogous to vanadium in its effect and therefore permitted at relatively higher ranges shown in Table I.

According to the invention alpha-two plus beta alloys, preferably having compositions which fall within the ranges set forth in Table I, are processed by multiple hot working and annealing steps, which are all conducted well below the beta transus temperature of the material, to produce a texture or preferred orientation. The processing temperature is desirably from 1900° to 1100° F. (preferably 1800° F. to 1200° F.) below the beta transus and usually working will be performed over a substantial portion of this range. The invention may be better understood through reference to the Figure which shows the room temperature tensile elongation values as a function of different processing applied to a material containing 13% aluminum, 23.9% niobium and 2.4% vanadium, balance titanium. This material has a beta transus temperature of about 2100° F. and would conventionally be processed above the beta transus temperature both during hot deformation and during annealing. The Figure shows that elongation increased as the working temperature decreased (the temperature shows is the temperature at the start of rolling).

The invention process permits the ready, economic fabrication of high quality alpha-two sheet material. The ductility of this sheet material permits the cold forming of complex shapes. The properties of the sheet and parts formed from the sheet can be tailored by subsequent heat treatment which can increase strength levels.

The foregoing and other features and advantages of the present invention will become more apparent from the following description and accompanying drawing.

BRIEF DESCRIPTION OF DRAWING

The drawing shows the tensile elongation of an alpha-two alloy as a function of rolling and annealing temperatures.

BEST MODE FOR CARRYING OUT THE INVENTION

As previously described the application process is applicable to alpha-two materials and preferably to those whose compositions are set forth in Table I. These materials are processed at temperatures below the beta transus temperature, typically about 2000° F., and more specifically are processed by hot working at starting temperatures of 1600°–1900° F. (preferably 1600°–1800° F.). In hot working, especially rolling the material usually cools during processing. The hot rolling in the invention starts at 1600°–1900° F. and proceeds until the material cools to 1400°–1100° F. and the material is then reheated and rolled further. At the completion of rolling, a 1–10 hour anneal at 1600°–1900° F. is preferred. The invention was developed in the context of hot rolling to produce sheet material but other forms of hot working such as forging, and extrusion are also within the scope of the invention.

In the case of production of sheet material, the starting alloy may be provided as ingot material or in the form of a metal powder compact. Metal powder compaction is conventional and can be by extrusion or hot isostatic pressing.

The starting material may have an exemplary thicknesses of 1–4 inches and a typical beta transus of 2000° F. This material is heated to 1750° F. and rolled in a rolling mill to produce 10–15% reduction per pass (this is the processing value which we used but other values are possible including increased reduction amounts, but insufficient to cause cracking). After 3–6 passes, when the temperature of the material has dropped to typically 1300° F. the material is reheated to the starting temperature of 1750° F. and held at this temperature for a time of 5–15 minutes for an intermediate anneal. It is within the scope of the invention that the annealing temperature may be different from the rolling temperature. When this rolling and reheating sequence has been repeated several times and the material thickness has been reduced to 0.020–0.100 inch the material will be given a final anneal. The final annealing temperature will range from 1500°–1900° F. (preferably 1600°–1800° F.) for times of at least 30 minutes and preferably 1–10 hours. From this point, cold rolling can be used to further reduce the material thickness and intermediate sub-beta transus anneals may be employed.

It has been found that the tensile ductility is anisotropic and that the maximum ductility is displayed in the rolling direction. For some applications it may be entirely satisfactory to have a sheet material displaying 35% ductility in the rolling direction and 10% ductility in the transverse direction. However if more isotopic properties are desired the material can be cross rolled in order to produce ductilities in excess of 25% in both the rolling direction and the transverse direction. Useful ductility improvements appears to require at least about a 60% reduction in area (sheet thickness in the case of rolling) is preferably at least 90%.

We have done limited x-ray analysis of this material and have found that material displaying the highest ductilities demonstrates a texture or preferred orientation of the individual alpha-two grains. Specifically, in the high ductility material the concentration of alpha-two basal planes (0002 type planes) in the rolling plane is as much as 20 times that which would be found in randomly oriented material. We believe that a texture intensity of at least 4 times random is required in order to produce ductilities in excess of 10% in this class of materials. Such texture intensification results from multiple hot working steps. This texture is however apparently a deformation texture rather than an annealing texture. We believe that at least three hot work plus anneal cycles are required and preferably at least five such cycles.

It is our belief that in this class of materials no one has ever produced ductilities in excess of 15% in alpha-two material and consequently we claim as part of our invention the fabrication of titanium alpha-two type materials having room temperature tensile ductilities in excess of 10% and preferably 20%. The currently favored alloy composition is 14% aluminum, 23% niobium, 2% vanadium.

Table II shows representative typical values for tensile properties for titanium alpha-two materials processed according to the present invention and processed conventionally according to the process as described in U.S. Pat. Nos. 4,292,077 and 4,716,020. It can be seen that the invention obtains greatly increased ductilities at some expense in yield strength.

Following production of sheet and fabrication of a particular shaped article the relationship between ductility and yield strength can be altered by heat treatments at higher temperatures, i.e. above 1900° F. or above the beta transus as described in U.S. Pat. No. 4,716,020, column 5, lines 22–40.

Although this invention has been shown and described with respect to detailed embodiments thereof, it will be understood by those skilled in the art that various changes in form and detail thereof may be made without departing from the spirit and scope of the claimed invention.

TABLE I

| | Broad | INT | PREF |
|---|---|---|---|
| Al | 12–22 | 13–20 | 13–20 |
| Nb | 10–33 | 18–30 | 18–30 |
| Mo | 0–6 | 0–3 | 0.5–3 |
| V | 0–6 | 0–4 | 0–4 |
| Ta | 0–6 | 0–3 | — |
| (Mo + V + Ta + Cr + W) | 0–8 | 0–5 | 0–5 |
| Cr | 0–4 | 0–3 | — |
| W | 0–4 | 0–3 | — |
| Si | 0–1 | 0–0.5 | — |
| (Mo + Cr + W) | 0–5 | 0–4 | — |
| Fe | <0.1 | — | — |
| C | <0.05 | — | — |
| O | <0.1 | — | — |
| H | <150 ppm | — | — |
| Ti | Bal | — | — |

TABLE II

| | Conventional | Invention |
|---|---|---|
| Ductility | 2–3% | 30–40% |
| *Y.S. | 100–120 ksi | 60–100 ksi |
| **U. T. S. | 110–130 ksi | 110–150 ksi |

*Yield Strength
**Ultimate Tensile Strength

We claim:

1. An article consisting essentially of, by weight, 12–22% Al, 10–33% Nb, up to 6% Mo, up to 6% V, up to 6% Ta, up to 4% Cr, up to 4% W, up to 1% Si, up to 5% (Mo+Cr+W), up to 8% (Mo+V+Ta+Cr+W), balance titanium, said article exhibiting at least 10% room temperature tensile ductility.

2. An article as in claim 1 which exhibits at least room temperature tensile ductility.

3. An article as in claim 1 whose composition consists essentially of, by weight, 13–20% Al, 18–30% Nb, up to 3% Mo, up to 4% V, up to 3% Ta, up to 3% Cr, up to 3% W, up to 0.5% Si, up to 4% (Mo+Cr+W), up to 5% (Mo+V+Ta+Cr+W), balance titanium.

4. An article as in claim 1 whose composition consists essentially of, by weight, 13–20% Al, 18–30% Nb, 0.5–3% Mo, up to 4% V, up to 5% (Mo+V), balance titanium, and which exhibits at least 20% tensile ductility.

5. An article as in claim 1 which displays a 0002) texture of at least 4X random in the rolling plane.

6. Method for producing ductile alpha-two titanium articles consisting essentially of, by weight, 12–22% Al, 10–33% Nb, up to 6% Mo, up to 6% V, up to 6% Ta, up to 4% Cr, up to 4% W, up to 1% Si, up to 5% (Mo+Cr+W), up to 8% (Mo+V+Ta+Cr+W), balance titanium, including the steps of a) hot working the material at a starting temperature between 1600° F.–1900° F., ceasing hot work when the temperature drops into the range of 1100°–1400° F., b) annealing the articles in the temperature range of 1500° F.–1900° F., and repeating steps a and b at least three times.

7. A titanium alloy article which contains alpha-two grains and optionally beta grains and which exhibits a room temperature ductility of at least 15%.

* * * * *